US008591190B2

(12) United States Patent
Tibbott

(10) Patent No.: US 8,591,190 B2
(45) Date of Patent: Nov. 26, 2013

(54) BLADE COOLING

(75) Inventor: Ian Tibbott, Lichfield (GB)

(73) Assignee: Rolls-Royce PLC, London (GB)

( * ) Notice: Subject to any disclaimer, the term of this patent is extended or adjusted under 35 U.S.C. 154(b) by 519 days.

(21) Appl. No.: 12/811,233

(22) PCT Filed: Dec. 11, 2008

(86) PCT No.: PCT/GB2008/004067
§ 371 (c)(1),
(2), (4) Date: Jul. 12, 2010

(87) PCT Pub. No.: WO2009/087346
PCT Pub. Date: Jul. 16, 2009

(65) Prior Publication Data

US 2010/0284807 A1 Nov. 11, 2010

(30) Foreign Application Priority Data

Jan. 10, 2008 (GB) ..... 0800361.8

(51) Int. Cl.
*F01D 5/08* (2006.01)

(52) U.S. Cl.
USPC ..... 416/97 R

(58) Field of Classification Search
USPC ..... 415/115, 116, 175; 416/90, 95, 96 A, 416/96 R, 97 A, 97 R, 231 R
See application file for complete search history.

(56) References Cited

U.S. PATENT DOCUMENTS 4,257,737 A * 3/1981 Andress et al. ..... 416/97 R
5,271,715 A * 12/1993 Zelesky et al. ..... 416/97 R
5,462,405 A * 10/1995 Hoff et al. ..... 416/97 R
5,624,231 A * 4/1997 Ohtomo et al. ..... 416/97 R (Continued)

FOREIGN PATENT DOCUMENTS

EP 1 055 800 A2 11/2000
EP 1 197 636 A2 4/2002
GB 2 262 314 A 6/1993

OTHER PUBLICATIONS

International Search Report issued Apr. 27, 2009 in International Patent Application No. PCT/GB2008/004067.

(Continued)

*Primary Examiner* — Nathaniel Wiehe
*Assistant Examiner* — Brian O Peters
(74) *Attorney, Agent, or Firm* — Oliff & Berridge, PLC

(57) ABSTRACT

Cooling of turbine blades within a gas turbine engine is important. Coolant flows are taken from the engine to provide cooling effects but diminish the efficiency of the engine. Blades rotate and therefore centrifugal effects stimulate flow and pressure to maintain coolant flow presentation upon the blade. More cooling effectiveness is required towards the root of a blade in comparison with the tip. By providing cavities which incorporate return apertures coolant flow can be recycled. The cavities incorporate return portions on one side of a feed passage and a constriction is provided in passage. Thus, a proportion of coolant within the cavities is returned to the passage with pressure maintained by the rotational and centrifugal effects upon the coolant flow through the feed passage. Coolant flow is presented through outlet apertures as a film upon a surface of a blade.

10 Claims, 4 Drawing Sheets

(56) References Cited

U.S. PATENT DOCUMENTS

| | | | | |
|---|---|---|---|---|
| 5,816,777 | A * | 10/1998 | Hall | 416/97 R |
| 6,139,269 | A * | 10/2000 | Liang | 416/97 R |
| 6,234,753 | B1 * | 5/2001 | Lee | 416/97 R |
| 7,104,757 | B2 * | 9/2006 | Gross | 416/97 R |
| 7,399,160 | B2 * | 7/2008 | Harvey et al. | 416/97 R |
| 2002/0018717 | A1 * | 2/2002 | Dailey | 416/97 R |
| 2002/0106275 | A1 * | 8/2002 | Harvey | 415/115 |
| 2007/0048136 | A1 * | 3/2007 | Boury et al. | 416/97 R |

OTHER PUBLICATIONS

Written Opinion of the International Searching Authority issued Apr. 27, 2009 in International Patent Application No. PCT/GB2008/004067.

United Kingdom Search Report issued Apr. 18, 2008 in United Kingdom Patent Application No. GB0800361.8.

* cited by examiner

BLADE COOLING

TECHNICAL FIELD

The present invention relates to blade cooling and more particularly to blade cooling with respect to turbine rotor blades within a gas turbine engine.

BACKGROUND ART

Referring to FIG. 1, a gas turbine engine is generally indicated at 10 and comprises, in axial flow series, an air intake 11, a propulsive fan 12, an intermediate pressure compressor 13, a high pressure compressor 14, a combustor 15, a turbine arrangement comprising a high pressure turbine 16, an intermediate pressure turbine 17 and a low pressure turbine 18, and an exhaust nozzle 19.

The gas turbine engine 10 operates in a conventional manner so that air entering the intake 11 is accelerated by the fan 12 which produce two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustor 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts 26, 28, 30.

In view of the above it will be appreciated that the performance of a gas turbine engine cycle, whether measured in terms of efficiency or specific output, is improved by increasing the turbine gas temperature. In such circumstances it is desirable to operate the gas turbine at the highest possible gas temperature. For any engine cycle, compression ratio or bypass ratio, increasing the turbine entry gas temperature will always produce more specific thrust but as turbine entry temperatures increase it will also be understood that the life of an uncooled turbine blade falls. In order to meet these increased turbine entry temperatures it is therefore necessary to develop better materials and to introduce internal cooling air.

In modern gas turbine engines the high pressure turbine gas temperature is generally now much hotter than the melting point of the material used and in some engine designs the intermediate pressure and low pressure turbines are also cooled to remain within acceptable operational parameters particularly for life expectancy. During passage through the gas turbine engine the mean temperature of the gas flow stream decreases as power is extracted so the need to cool static and rotating parts of the engine decreases as the gas moves from the high pressure stages through the intermediate and low pressure stages towards an exit nozzle.

It is known to utilise internal convection and external coolant films as methods for cooling in gas turbine engines. In such circumstances high pressure turbines and nozzle guide vanes (NGVs) consume relatively large amounts of cooling air on high temperature parts of engines. High pressure blades typically use about half the cooling air that is required for the nozzle guide vanes. The intermediate and low pressure stages downstream of the high pressure turbine use progressively less cooling air.

FIG. 2 provides an isometric view of a typical single stage cooled high pressure turbine arrangement including a nozzle guide vane assembly 31 and a high pressure turbine blade assembly 30. The nozzle guide vane assembly 31 includes guide vanes 32 presented between an inner platform 33 and an outer platform 34. The high pressure turbine rotor blade assembly comprises blades 35 extending from platforms 36 secured through roots 37 to a rotor assembly 38. At an outer end 39 of the blades 35 shrouds are provided to limit gas flow leakage.

Cooling of the blades 35 and the guide vanes 32 is achieved through use of high pressure air bleed from a compressor (not shown). Part of the high pressure air flow from the compressor bypasses the combuster and is therefore relatively cool compared to the gas temperature driving the blades 35 and guided by the aerofoil 32. Typically the temperatures will be in the order of 700 to 1,000K whilst the gas temperatures presented to the vanes 32 and the blades 35 will be in excess of 2,100K. It will be understood that the cooling air from the compressor (not shown) utilised to cool the hot turbine components is not utilised to produce work from the turbine and so the engine. In such circumstances the coolant flow represents lost power and therefore has an adverse effect upon overall engine operating efficiency. Thus it is important to utilise the cooling air as effectively as possible.

Previously it is known to provide cooling effects with respect to the high pressure turbine rotor blades using a combination of internal convective cooling and external film cooling. The leading edge portion of turbine blades is therefore cooled by such processes and utilises either augmented channel flow or impingement convective cooling plus film cooling in the region of the stagnation point for the blade.

Impingement cooling is considered superior to augmented channel flow and is favoured when dealing with modern engine applications running at elevated gas temperatures as illustrated above. However, the important peak heat transfer coefficient levels associated with impingement jet cooling are only attainable when adequate pressure ratios are achieved across the jets. The pressure ratios drive the required cooling flow levels through the jets to keep the Reynolds numbers as high as physically possible within overall design constraints. It will be appreciated the design constraints that limit the impingement jet cooling performance include coolant feed pressure upstream of the jets and local gas path static pressure distribution on the external surface of the respective aerofoils defining the turbine blades such as in the vicinity of the aerofoil leading edge.

FIG. 3 provides a schematic cross sectional view through an aerofoil blade 41 with an impingement cooled leading edge arrangement 42. It will be appreciated that coolant flows pass in the direction of the arrowheads depicted. In such circumstances the coolant passes radially up an augmented feed passage 43 towards a tip of the blade 41. A series of impingement jets progressively bleed coolant through apertures 44 (i.e., 44*a*, 44*b* and 44*c*) across a divider wall into a number of individual impingement plenum chambers or cavities 45 (i.e., 45*a*, 45*b* and 45*c*) aligned radially up the leading edge of the blade 41. These cavities 45 are typically referred to as Boxcars and act as pleniums from which the leading edge film cooling flow is bled under pressure out of outlet apertures (i.e., 46*a*, 46*b* and 46*c*) to provide a film cooling effect 47 on an external surface of the aerofoil defining the blade. The pressure in the chambers or cavities 45 is kept at a level suitably above that of the local gas flow about the blades in order to ensure that hot gas ingestion never occurs under adverse operating conditions even when the engine and in particular the blades are nearing the end of their useful life.

In the above circumstances the impingement jet pressure ratio is virtually fixed along with the quantity of coolant that can be presented across the apertures 44, 46 for a given design of aerofoil in a blade 41. The level of transferred coolant air through the jets or apertures 44, 46 is therefore also virtually fixed unless pressure can be increased to the blade. Unfortunately, increasing the pressure to the blade can only be achieved at the expense of engine performance and is limited due to increased leakage (FIG. 2) and work extraction pumping the air up the front face of the disc to the blade feed passage 43. As can be seen in FIG. 3 the apertures 44 are generally angled with respect to the feed passage flow in such a manner that a proportion of the dynamic pressure head in addition to the static pressure is utilised to drive an impingement flow A across the cavities 45 to the apertures 46. Such an approach helps maximise available pressure ratio across to the apertures or jets 44. It will be appreciated that the inflows to cavity 45 through the apertures 44 must equal the outflow from that cavity through the outlet apertures 46.

In FIG. 3 the pressure in the feed passage 43 will generally increase as it flows up the blade from root to tip due to a centrifugal effect of rotation. In such circumstances, rotation provides a pumping effect which results in the feed pressure being higher at the entrance to the apertures 44 at the outer parts 44*c* compared to the feed pressure for the inner cavities 45 through inner apertures 44*a* and 44*b*. Furthermore, the external static pressure distribution also rises from the root to the tip of the blade but not as much as that internal pressure and consequently the pressure ratio across the apertures 44 rises from the root to the tip up the leading edge of the blade 41. Such increases in the pressure ratio will lead to levels of impingement heat transfer which also rise further up the leading edge of the blade 41. However, the heat load experienced by the blade 41 leading edge generally peaks at approximately mid span due to the radial gas temperature distribution originating from the combustor. This heat distribution is difficult to accommodate with previous cooling arrangements.

It will also be appreciated that in addition to the effects described above radial stress distribution will tend to be higher at the root sections and lower at the tip sections of the blade 41 due to the centrifugal loading on the aerofoil of the blade 41. Therefore, there is typically a need to cool the lower and mid portion of the aerofoil of the blade 41 more than the tip to retain structural integrity. However, as indicated, the internal cooling due to the pressure differential as a result of rotation is generally more effective at the tip of the blade 41.

SUMMARY

In accordance with this disclosure there is provided a component for a gas turbine engine, the component having a feed passage for a coolant and a plurality of cavities, the feed passage having a constriction, the plurality of cavities including: an inlet aperture and a return aperture located in the constriction, coolant is bled from the feed passage through the inlet apertures into the cavities and flows back into the feed passage through the return apertures located in the constriction to draw the coolant flow through the return aperture.

The cavities may incorporate outlet apertures.

The outlet apertures may be aligned with the inlet apertures.

The outlet apertures and the inlet apertures may be presented at respective angular positions to facilitate coolant flow through the outlet apertures upon the surface.

The return aperture may be out of a flow projection direction for the inlet apertures.

The return aperture may be presented in a portion of the cavity to provide the constriction.

One side of the feed passage may define a wall for the cavity and a part of the one side may impinge inwardly of the feed passage to define the constriction.

All cavities in the cooling arrangement may incorporate a return aperture.

The return apertures may be of different configuration.

The return apertures may be of different configurations in terms of size, shape, length and angle relative to the feed passage and/or inlet apertures and/or outlet apertures.

The return apertures may be different dependent upon distance from an entrance end of the feed passage for coolant.

The constriction may be provided in an opposite side of the feed passage to the return aperture.

The constriction may be provided as an element in the feed path.

The constriction may be adjustable in size and so the level of restriction of the feed path.

The component may be a blade for a gas turbine engine.

Aspects of the disclosure will now be described by way of example with reference to the accompanying drawings.

DETAILED DESCRIPTION

As described above problems relate to achieving effective cooling whilst optimising utilisation of coolant within a gas turbine engine. It would be advantageous to switch the cooling effectiveness levels in comparison with prior arrangements from the tip of a blade towards the root and mid parts of the blade's leading edge portion.

In order to achieve such control as described above with regard to heat transfer, the present disclosure relate to providing a means of controlling the level and radial distribution of heat transfer by providing higher levels of heat transfer coefficient at the root and lower levels at the tip of a blade's aerofoil leading edge. In such circumstances more judicious utilisation of the available coolant is achieved. The present disclosure achieve such distribution by utilising portions of the impingement coolant air over and over again as it passes up the aerofoil leading edge. An effective cascade is achieved where the quantity of cooling air entering an impingement cavity is generally greater than the quantity of coolant exiting the cavity in the form of leading edge film cooling as described above with regard to exit from apertures 46. A proportion of the "spent" impingement cooling air is returned to the feed passage from which it originated in order to be used again at a radial location higher up the span of the blade. The returned coolant will have provided some cooling effect in the cavity and therefore the coolant feed to subsequent cavities is warmer and so has a reduced cooling effect.

As indicated a portion of coolant thus is re-used. However, it will be appreciated the inflow to a cavity is equal to the outflow through the outlet apertures for film cooling of the blade edge combined with the returned flow to the feed passage. The impingement inflow to the cavity, as indicated cooling initially by impingement upon cavity walls and then through film cooling through the outlet apertures. Thus, the proportion of coolant returned is warmed by the initial impingement cooling effect.

Figure 4:
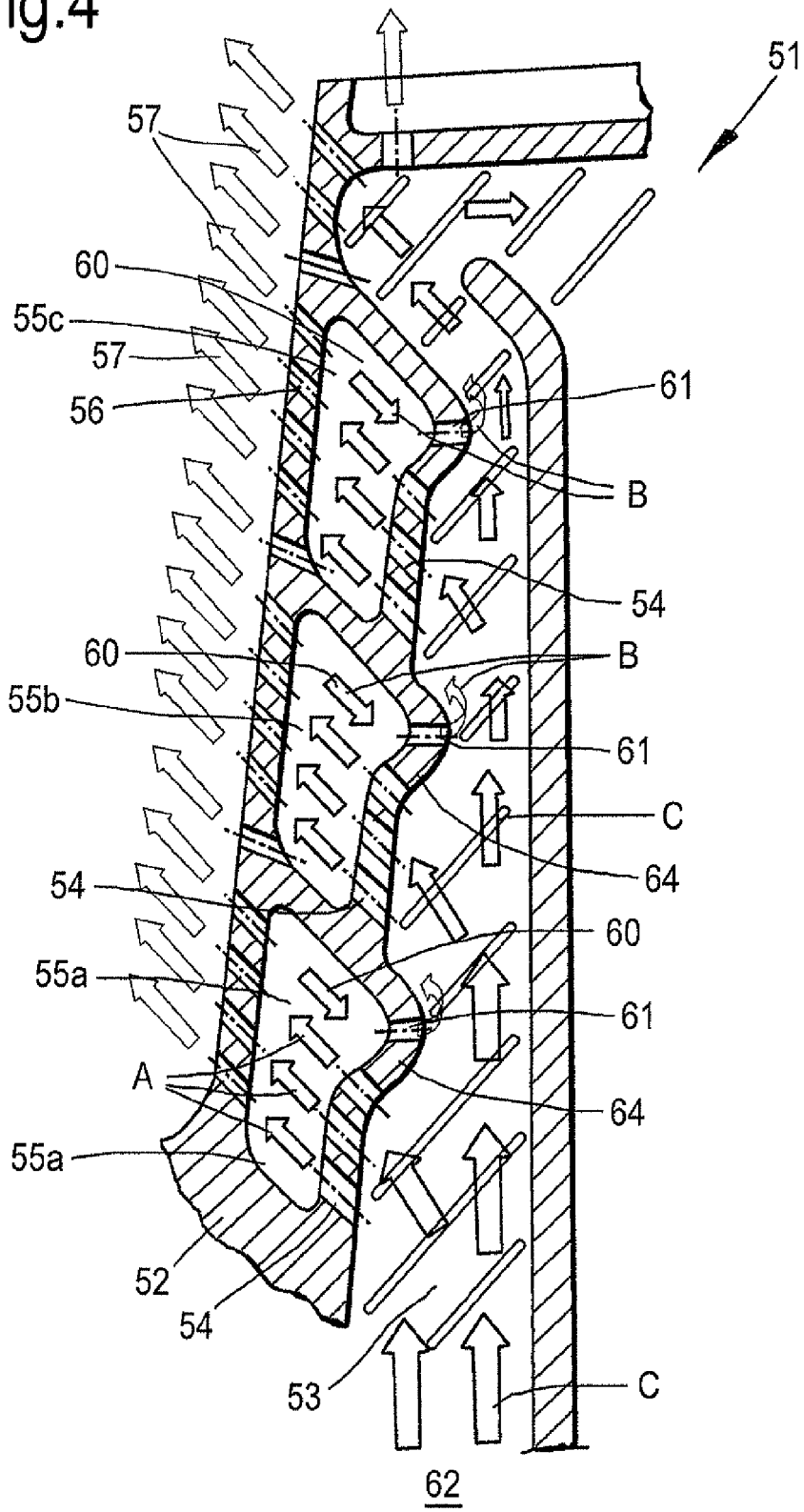
FIG. 4 is a schematic cross-sectional view through a turbine blade configured in accordance with the present disclosure.

FIG. 4 provides a schematic cross section of an aerofoil portion of a blade 51. As indicated the configuration of the current arrangement in the blade 51 allows re-use of cooling flow illustrated by the arrowheads as it cascades upwards along a leading edge of the blade 51.

Coolant flow is bled from a feed passage 53 through inlet apertures 54 into cavities 55 (i.e., 55*a*, 55*b* and 55*c*) and thence ejected through outlet apertures 56 to provide a cooling film for the blade 51. As indicated previously the blade 51 defines the cavities 55 in a surface portion 52 of the blade 51.

The coolant is bled as indicated through the apertures 54 and is generally pumped through rotational speed as well as the pressure differential out of the outlet apertures 56. The pressure driving the coolant flow is greater than the gas flow pressure within the gas turbine engine. In order to achieve this effect as described previously the cavity 55 generally achieves an over pressure in comparison with the gas path over the blades surface in the gas turbine engine. The inlet apertures 54 and outlet apertures 56 are generally aligned and angled with the rotational and centrifugal forces to generate and present the necessary force for projection of the coolant defining the surface cooling 57.

A proportion of the coolant flow B in a return zone or portion 60 is returned to the feed passage 53. This return portion 60 is generally on a radially outward side of the cavity 55 in order to take advantage of the centrifugal and rotational forces present within the blade 51 in use. The spent coolant flow B, is warmed by impingement cooling and not projected through the outlet apertures 56, flows back into the feed passage 53 through return apertures 61. The coolant B in the portion 60 is pressurised and drawn by Venturi effects through the return aperture 61.

A single large hole or a series of smaller holes may be utilised with respect of the return aperture 61 dependent upon operational requirements. Furthermore, the configuration in terms of the return aperture 61 may be utilised to provide a degree of proportionality in the return flow B. The return aperture 61 may have different sizes, lengths, angles and shape dependent upon requirements within the blade 51. It will be appreciated that such differentials will generally be with regard to the distance of an associated cavity 55 from an entrance end 62 of the feed passage 53.

In order to be more effective the feed passages 53 are appropriately shaped. By careful shaping constrictions or restrictions 64 are formed in the feed passage 53 through bulges in a wall defining one side of the passage 53. Such constriction or restriction 64 will effectively throttle and locally accelerate the coolant flow (arrowheads) within the feed passage 53. This will provide a pressure drop or regulation to draw returned coolant flow through the return apertures 61. The shaping and constriction 64 in the wall of one side of the feed passage 53 will also provide a recessed position for the return aperture 61 in the cavity 52 such that the apertures 61 are not aligned with a flow direction A from at least the inlet impingement apertures 54 towards the outlet apertures 56. The constriction 64 will lower local static pressure in the feed passage 53 of the coolant flow C to a level below the total pressure within the cavities 55 is hence returned coolant flow through the return aperture 61.

The returned coolant flow to the feed passage 53 through the return apertures 61 will then mix with the coolant flow within the passage 53 altering its temperature significantly before repeating the process at a further radial location in cavities 55 further away from the entrance end 62 of the feed passage 53. The coolant is repeatedly used and in a more effective manner. Cooler coolant will be utilised in cavities 55*a* nearer to the root for the blade 51 which generally experience higher temperatures whilst hotter coolant flows will be presented at more radially displaced and therefore distant positions from the entrance end 62 of the passage 53 towards the tip of the blade 51 where cooling is less vitally necessary.

Generally the feed passage 53 in terms of cross sectional area immediately downstream of the constriction 64 provided by shaping of one side of the passage 52 is such that it rapidly increases negating the effects of local radial velocity and as indicated increasing local static pressure. The additional pumping effect due to the blade's rotational speed further increases the feed pressure within the feed passage 53 and so serves to cancel the pressure losses occurring by the sudden contraction followed by sudden expansion in the coolant flow (arrowheads) within the passage 53 across the constriction 64. By regulating the total pressure level in the passage the impingement pressure ratio across subsequent inlet apertures 54 is maintained leading to and adjustment in the coolant flow into subsequent cavities 55. This repeated cascade process occurs a number of times from cavities 55*a* adjacent to a root of the blade 51 towards cavities 55*c* towards the tip of the blade 51.

By utilising a cooling arrangement as described in FIG. 4 as indicated coolant utilisation is enhanced with the coolant film cascaded along the blade and coolant re-used a number of times. The number of impingement outlet apertures 54 and outlet apertures 56 can be increased or adjusted dependent on radial position elevating the level of heat transfer without using additional quantities of cooling air or additional coolant air feed pressure to enhance performance with respect to cooling towards cavities 55*a* in portions of the blade 51 requiring higher levels of cooling efficiency.

The pressure ratios across the inlet impingement apertures 54 in particular can be effectively fixed whilst flow levels through these apertures 54 can be increased as required along with the levels of heat transfer coefficient. The distribution of heat transfer coefficients can be varied with respect to cavity positions and therefore outlet apertures 56 along the surface of the blade 51. Typically, this variation will mean cavities 55*a* towards the root will have high cooling compared to those cavities 55*c* towards the tip of the blade 51 irrespective of the pressure rise due to centrifugal pumping as a result of rotation of the blade 51.

Coolant flow entering the cavities 55 is generally greater than the film coolant flow leaving the cavities 55 through the outlet apertures 56 resulting in a return of coolant flow through the return apertures 61. The inflow substantially equals the flow through the outlet apertures 56 combined with the return flow to the feed passage 53. The returned coolant flow as indicated is repeatedly used over and over again along the feed passage 53. The disclosed cooling arrangement achieves higher levels of heat transfer coefficient without requiring an increase in feed pressure or in coolant flow rates within the blade 51.

Double rows of inlet impingement apertures 54 can deliver increased coolant flow impingement upon the surface of the blade 51 defining the outlet apertures 56 further cooling that surface through convection and radiation.

Figure 1:
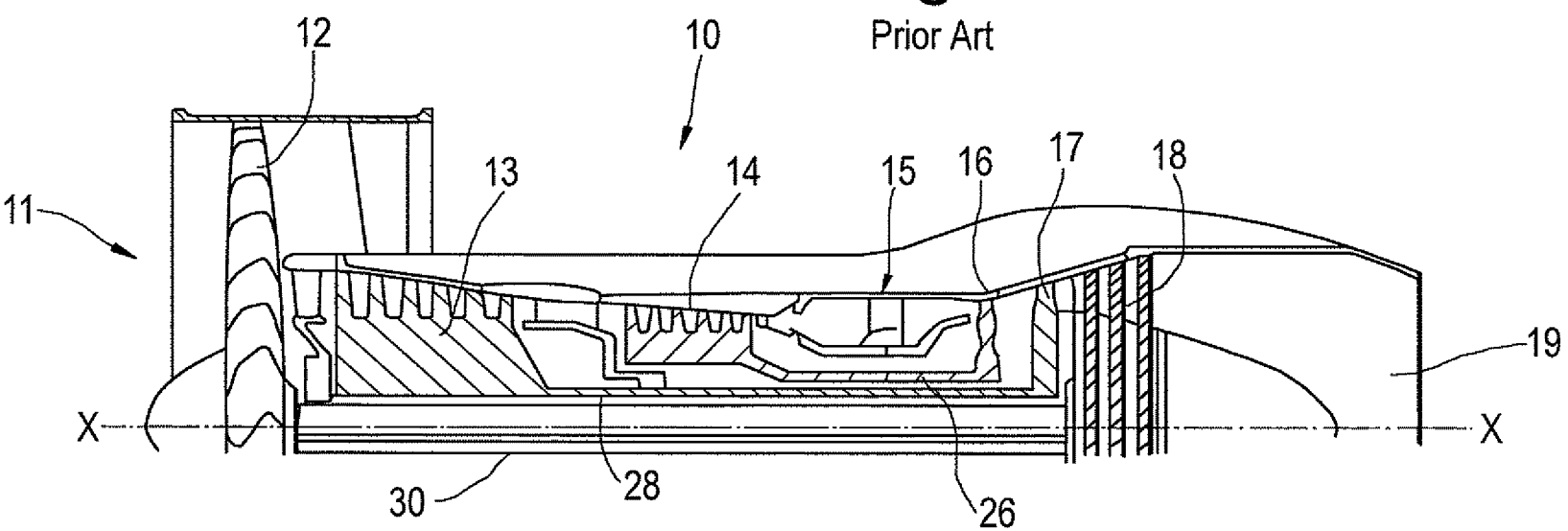
Fig. 1 Prior Art
FIG. 1 is a schematic section through a conventional gas turbine engine.
Figure 2:
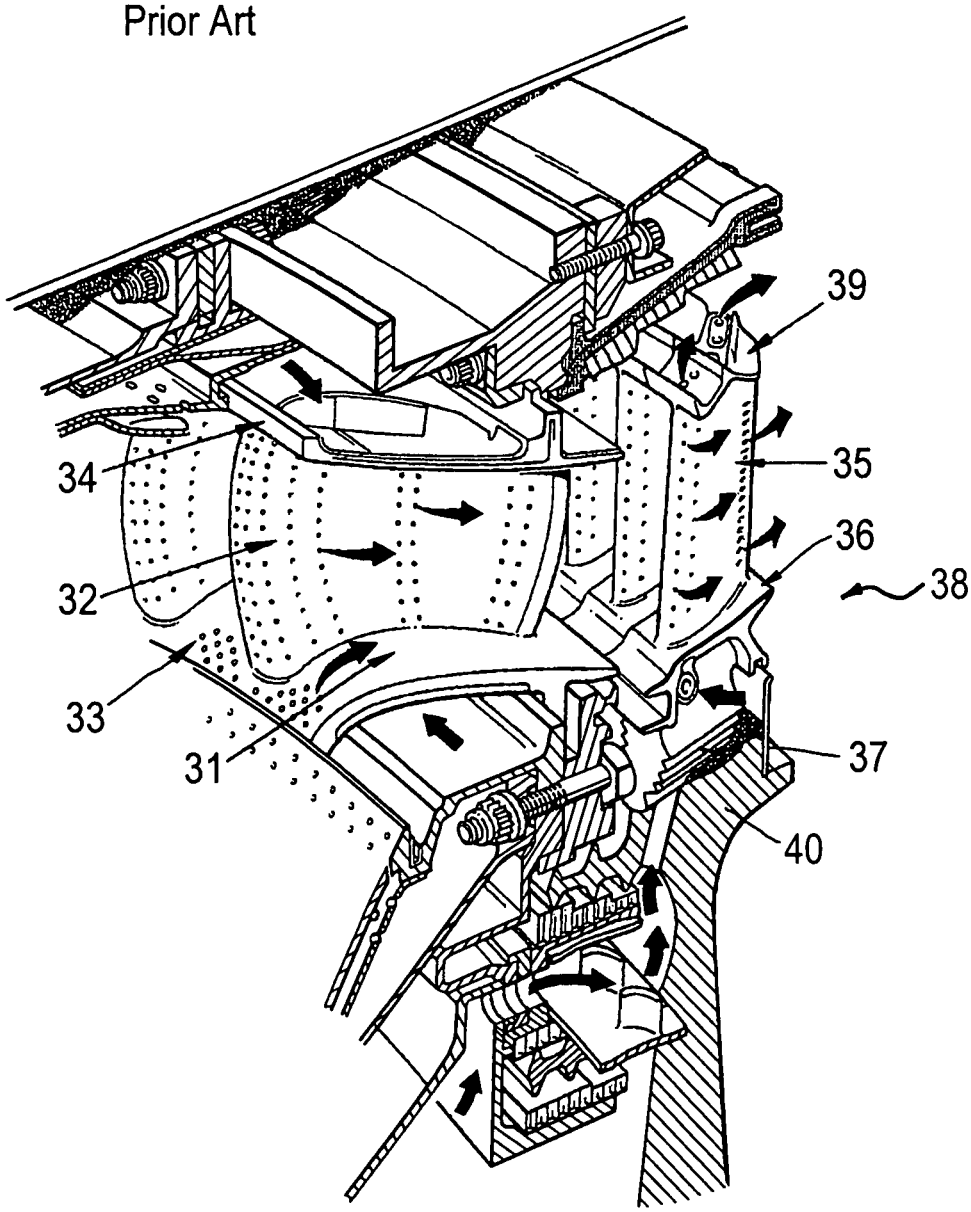
Fig.2 Prior Art
FIG. 2 is a cut away view of part of a turbine of the gas turbine engine.
Figure 3:
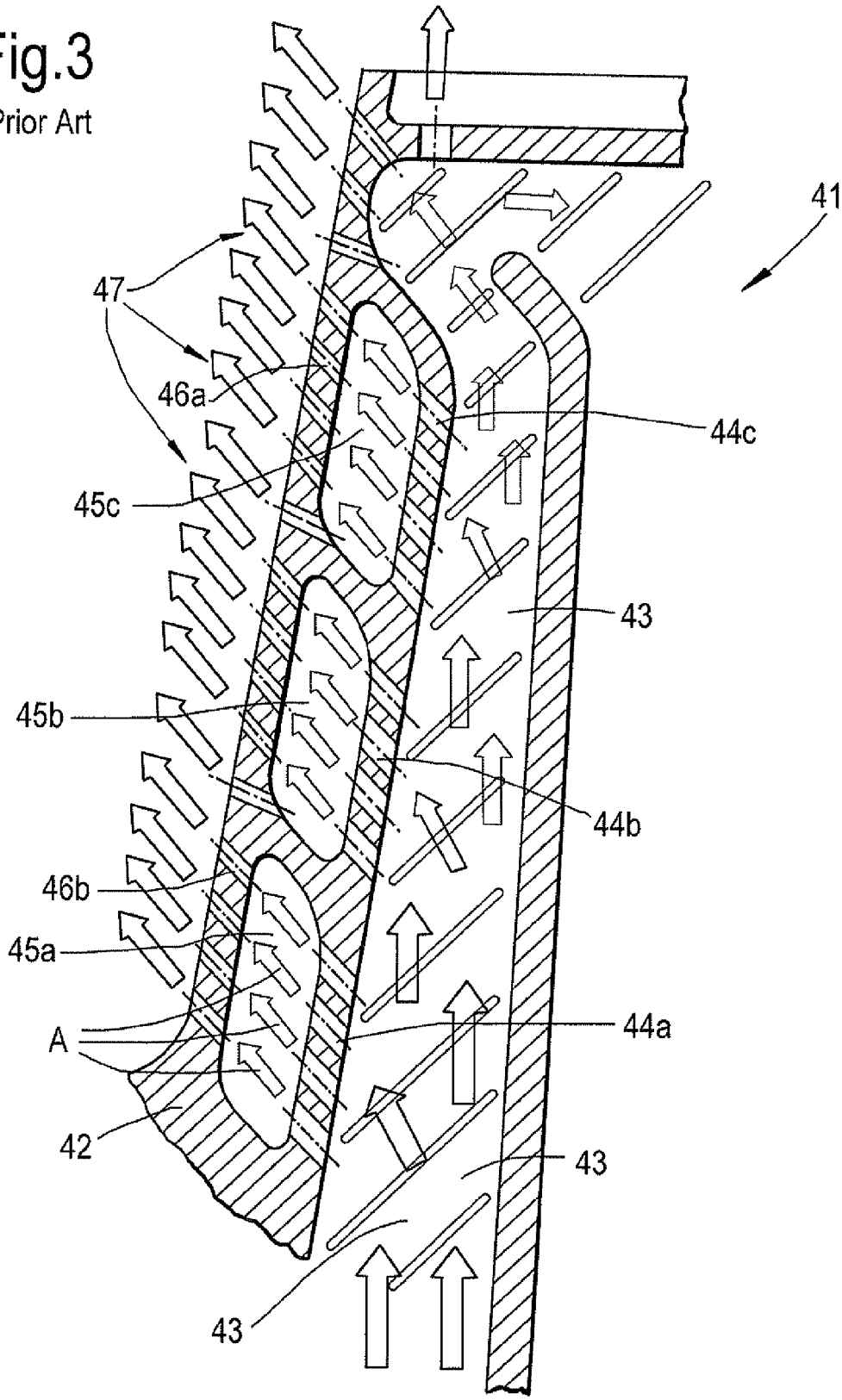
Fig.3 Prior Art
FIG. 3 is a cross-section of part of a prior art turbine blade.

The cooling arrangement will require more complex geometry with respect to the blade 51 construction. However, such complexity will be justified in view of the higher levels of heat transfer coefficient compared to previous simple augmented channel flows as described above with regard to FIG. 3. Higher levels of cooling effectiveness can be achieved without a corresponding increase in overall cooling flow and pressure requirements. It will also be understood that the leading edge cooling effectiveness and distribution can be more easily optimised from a stress and heat load viewpoint which again should result in improved component life for the blade 51 in operational use.

The practical configuration of the feed passage along with apertures 54, 55, 61 will depend upon operational requirements. As depicted these apertures 54, 56, 61 may be angled or provided in a perpendicular or angled relationship or a combination of both in different spatial distributions within the blade 51 to achieve desired objectives.

The return apertures as indicated above can be configured as single holes or multiple circular holes or elliptically shaped holes or slots with differing depths and otherwise to achieve effectiveness with respect to return of coolant flow to the feed passage 53.

In order to improve convection cooling within the cavities it will be appreciated that these cavities may incorporate fins to increase the wetted surface and therefore cooling effectiveness of the coolant flow within the cavity prior to utilisation of at least a proportion of that coolant flow to generate the coolant film 57 upon the surface of the blade 51.

In order to be effective the feed passage will have a constriction associated with the return aperture. As illustrated, the constriction can be in the same side of the passage wall as the return aperture. However, the constriction may be in an opposite wall to the return aperture or a constriction provided by inward shaping of both sides of the feed passage. Additionally, or alternatively, the constriction can be provided by an element located within the feed passage to provide a restriction or constriction to facilitate return flow through the return aperture.

The degree of constriction of the feed passage can be consistent for all return aperture locations or may alter radically with typically greater constriction at outer radial positions.

The return apertures are normally presented at the point of greatest constriction or pinch in the feed passage to provide the desirable pressure regulator to stimulate return flow through the return aperture. However, to adjust effectiveness, the return aperture may be angled and/or placed slightly off such a position if required, particularly when multiple return apertures are provided for a constriction.

In addition to cooling surfaces the cooling arrangement may also be utilised with regard to radial cascade impingement cooling of other parts of a blade or other components in a gas turbine engine. Furthermore, where possible a leading edge cooling arrangement can be achieved in which the outlet apertures are removed such that the coolant flow simply enters the cavities for cooling effect with no film cooling in such circumstances the return holes will simply act to return the coolant flow to the feed passage 53 in the form of so-called suction surface gill holes or otherwise.

The invention claimed is:

1. A component for a gas turbine engine, the component comprising:

a feed passage for a coolant, the feed passage including a plurality of constrictions; and a plurality of cavities, the plurality of cavities each comprising:

at least one inlet aperture; and a return aperture disposed at a radial position corresponding with one of the pluralities of constrictions, wherein coolant is bled from the feed passage through the at least one inlet aperture into each of the plurality of cavities and flows back into the feed passage through the return aperture corresponding with one of the constrictions to draw the coolant flow through the return aperture.

2. The component as claimed in claim 1, wherein the coolant flows out of the return aperture in a different direction from the coolant that flows through the inlet apertures into the cavities.

3. The component as claimed in claim 1, wherein the plurality of constrictions are adjustable in size so as to increase or decrease the level of restriction of the feed path.

4. The component as claimed in claim 1, wherein the component is a blade for a gas turbine engine.

5. The component as claimed in claim 1, wherein each of the plurality of cavities includes at least one outlet aperture.

6. The component as claimed in claim 5, wherein each of the at least one outlet aperture is aligned with each of the at least one inlet aperture.

7. The component as claimed in claim 5, wherein the at least one outlet aperture and the at least one inlet aperture extend in substantially the same angle to facilitate coolant flow through the outlet apertures upon the surface.

8. The component as claimed in claim 1, wherein one side of the feed passage defines a wall for the cavity and parts of the one side impinges inwardly of the feed passage to define the plurality of constrictions.

9. The component as claimed in claim 5, wherein the return apertures are of different configuration from at least one of the feed passage, inlet apertures and outlet apertures in at least one of size, shape, length and angle.

10. The component as claimed in claim 5, wherein the return apertures are different from at least one of the feed passage, inlet apertures and outlet apertures in at least one of size, shape, length and angle dependent upon distance from an entrance end of the feed passage for coolant.

* * * * *